United States Patent [19]

McNeilly et al.

[11] Patent Number: 4,479,113

[45] Date of Patent: Oct. 23, 1984

[54] COMPENSATED INTRUDER-DETECTION SYSTEMS

[75] Inventors: David R. McNeilly, Maryville; William R. Miller, Andersonville, both of Tenn.

[73] Assignee: The United States of America as represented by the United States Department of Energy, Washington, D.C.

[21] Appl. No.: 340,907

[22] Filed: Jan. 20, 1982

[51] Int. Cl.[3] ..... G08B 29/00

[52] U.S. Cl. ..... 340/501; 340/550; 340/556; 340/566

[58] Field of Search ..... 340/501, 541, 566, 556, 340/550, 587

[56] References Cited

U.S. PATENT DOCUMENTS

| | | | |
|---|---|---|---|
| 3,902,040 | 8/1975 | Ikeda et al. | 340/501 |
| 4,326,199 | 4/1982 | Tarpley et al. | 340/501 |
| 4,420,746 | 12/1983 | Malinowski | 340/501 |

OTHER PUBLICATIONS

Intrusion Detection Systems, Inc., "All Weather, All Terrain, All Area Protection at a Sensible Cost", pp. 1–8, San Leandro, CA.

"Seismic Detection System Protects this Hard-to-Secure Facility", *Security World* XVI, 4, (Apr., 1978), pp. 28–29, 98, 100, Los Angeles, CA.

*Primary Examiner*—Glen R. Swann, III

*Attorney, Agent, or Firm*—David E. Breeden; Stephen D. Hamel; Michael F. Esposito

[57] ABSTRACT

Intruder-detection systems in which intruder-induced signals are transmitted through a medium also receive spurious signals induced by changes in a climatic condition affecting the medium. To combat this, signals received from the detection medium are converted to a first signal. The system also provides a reference signal proportional to climate-induced changes in the medium. The first signal and the reference signal are combined for generating therefrom an output signal which is insensitive to the climatic changes in the medium. An alarm is energized if the output signal exceeds a preselected value. In one embodiment, an acoustic cable is coupled to a fence to generate a first electrical signal proportional to movements thereof. False alarms resulting from wind-induced movements of the fence (detection medium) are eliminated by providing an anemometer-driven voltage generator to provide a reference voltage proportional to the velocity of wind incident on the fence. An analog divider receives the first electrical signal and the reference signal as its numerator and denominator inputs, respectively, and generates therefrom an output signal which is insensitive to the wind-induced movements in the fence.

10 Claims, 3 Drawing Figures

COMPENSATED INTRUDER-DETECTION SYSTEMS

BACKGROUND OF THE INVENTION

This invention relates generally to electrical intrusion-detection systems and, more particularly, to an improved detection system having low susceptibility to false alarms. The invention is a result of a contract with the United States Department of Energy.

Although electrical intrusion-detection systems are in widespread use, the typical system is subject to false alarms resulting from gradual changes in the signal-transmission characteristics of the detection medium. For example, a system designed to respond to intruder-induced vibrations in a plot of ground is likely to false-alarm if the ground freezes or if its water content changes because of rain. As another example, a system designed to respond to intruder-induced vibrations in a fence will false-alarm if the fence is exposed to wind of sufficient velocity. The susceptibility of such systems to such false alarms can be decreased by reducing the overall sensitivity of the system, but this is counterproductive.

Accordingly, it is an object of this invention to provide an improved intrusion-detection system.

It is another object to provide an intrusion-detection system which is insensitive to spurious signals resulting from climate-induced changes in the detection medium.

It is another object to provide an intrusion-alarm circuit characterized by substantially constant sensitivity to intruder-generated signals.

Other objects and advantages will be made evident hereinafter.

SUMMARY OF THE INVENTION

In a first aspect, the invention is an improvement to an intruder-detection system of the kind where intruder-induced signals are transmitted through a medium whose conductance varies with certain climatic conditions. The improved system includes means coupled to the medium for converting the intruder-induced signals received therefrom to a first electrical signal. Means also are provided for generating a reference signal proportional to the climate-induced changes in the signal-conductance of the medium. Means are provided for generating, from the first electrical signal and the reference signal, an electrical output signal which is unaffected by the changes in signal-conductance. Means are provided to give warning when the output signal exceeds a selected value.

In another aspect, the invention is a method for operating an intruder-detection system of the kind wherein an intrusion-generated signal transmitted through a detection medium is converted to a first electrical signal. The first electrical signal contains variations resulting from climate-induced changes in the medium. The method of the invention comprises generating an electrical reference signal proportional to the climate-induced changes in the medium; conditioning the first signal with the reference signal to produce an electrical output signal which is unaffected by the climate-induced changes in the medium; and impressing the resulting output signal across an alarm circuit to actuate the same when the output signal exceeds a selected value.

DETAILED DESCRIPTION OF THE INVENTION

Figure 1:
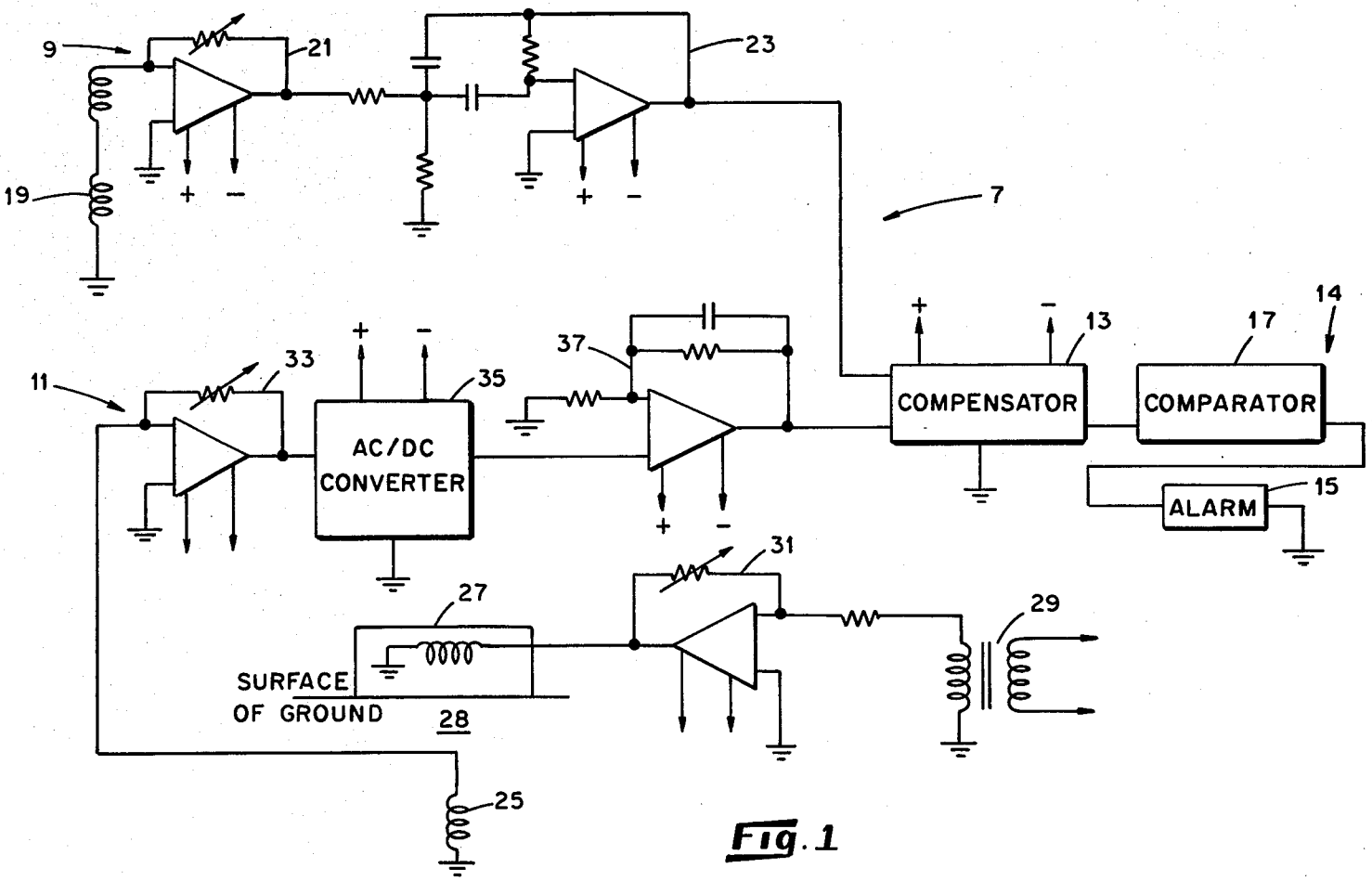
FIG. 1 is a diagram of an intrusion-alarm circuit utilizing earth as the detection medium; in accordance with the invention, the circuit is designed to operate free of false alarms produced by climate-induced changes in the detection medium.

FIG. 1 illustrates our invention as embodied in an electrical circuit designated generally as 7. The circuit 7 includes a detection branch 9, a reference branch 11, a compensator 13, and an alarm arrangement 14 which includes an alarm 15 and a comparator 17 for presetting the threshold of the alarm. The entire circuit 7 may consist of standard components. As will be described, circuit 7 utilizes earth (soil) as a detection medium and is designed to compensate for climate-induced changes in the signal-conductance of the detection medium as well as certain spurious signals (to be described).

The detection branch 9 includes an array 19 of acoustic-to-electric transducers (e.g., geophones) defining an exclusion area. The transducers are buried in the ground to respond to vibrations produced therein by an intruder. The transducer output is fed to a gain amplifier 21 for adjusting the sensitivity of the geophones. As shown, the amplifier output is fed to a standard band-pass filter arrangement 23, which is designed to amplify frequencies that are characteristic of intruder-induced vibrations. The A.C. output from the filter is referred to herein as the detection signal.

In accordance with the invention, the reference branch 11 includes a buried reference transducer 25 which is similar to those in the array 19. A vibrator 27 of any suitable design is provided for generating constant-amplitude vibrations which are transmitted to the reference transducer through a portion 28 of the ground. The vibrator and its associated transducer are located somewhat apart from the array 19 so that the reference and detector arrays do not interfere with each other yet use the same detection medium. In the particular arrangement shown, the excitation voltage for the vibrator is supplied by a transformer 29 whose output is fed through an adjustable amplifier stage 31.

The output signal from the reference transducer 25 is fed to an amplifier stage 33, whose output is impressed on an A.C.-to-D.C. converter 35. The resulting D.C. output is fed to a standard low-pass filter arrangement 37 designed to amplify frequencies characteristic of climate-induced changes in the signal transmitted through ground portion 28. These changes are slow compared with intrusion-induced changes in the above-mentioned detection signal. The non-inverted D.C. output from the filter arrangement 37 is referred to herein as the reference signal.

As shown, the A.C. detection signal (branch 9) and the D.C. reference signal (branch 11) are fed into a compensator 13, which in this particular illustration is a standard fast-acting analog divider. The detection signal constitutes the numerator of the fraction to be divided, and the reference signal constitutes the denominator. The output signal from the divider is fed to the alarm circuit 14.

With the system in the quiescent (no-intrusion) condition, the detection signal (numerator) to the divider may be, say, 10 volts, and the reference signal (denominator), 20 volts. With these inputs, the resulting output signal from the divider is a 0.5 volt A.C. signal having the same waveshape and peak amplitude as the detection signal. The threshold for the alarm circuit 14 has been pre-set at some value above 0.5 volt. Because both the detection branch 9 and reference branch 11 incorporate ground (soil) as a signal-transmission medium, climate-induced changes in the acoustic conductance of the ground change the detection signal and the reference signal by the same percentage. That is, climate-induced changes vary the above-mentioned numerator and denominator values correspondingly. Thus, the divider output is unaffected by such changes and remains at the illustrative value of 0.5 volt. In other words, the system shown in FIG. 1 is characterized by freedom from false alarms of the kind described and by a constant sensitivity to intrusions. The system compensates for climate-induced changes in the signal-conductance of the detection medium—i.e., changes due to freezing/thawing effects and variations in moisture-content. It also compensates for spurious signals resulting from the impingement of rain and hail.

EXAMPLE

An intrusion-detection system of the kind illustrated in FIG. 1 was field-tested and was found to operate satisfactorily. For instance, the system maintained an essentially constant sensitivity to simulated intrusions despite changes in the acoustic conductivity of the ground resulting from significant changes in its moisture content. The input to the transformer 29 was 115 volts, 60 Hz. The various geophones were Model 28-600, manufactured by Geo-Space Corporation. With the exception of amplifier 37, the various operational amplifiers were operated in the inverting mode. The A.C.-to-D.C. converter was Model AD 536, manufactured by Analog Devices. The analog divider used as the compensator 13 was Model 436, manufactured by Analog Devices. The vibrator was a continuously driven electrical vibrator of conventional design, mounted to impart vibrations to the surface of the ground.

Figure 2:
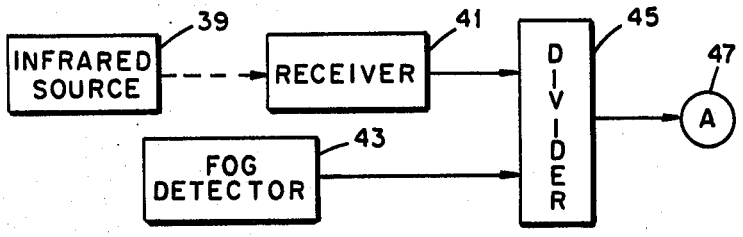
FIG. 2 is a schematic diagram of an intrusion-alarm system utilizing air as the detection medium; in accordance with the invention, the system is designed to be insensitive to changes in the fog content of the air.

FIG. 2 is a highly schematic showing of another form of the invention as utilized to compensate for fog-induced false alarms in an intrusion detection system where a beam of infrared radiation from a source 39 is transmitted through air to a receiver 41. The receiver generates a proportional electrical output, or detection signal. In accordance with the invention, a fog detector 43 is used to generate an electrical reference signal proportional to the fog content of the air. The detection signal and reference signal constitute the numerator and denominator inputs, respectively, to a divider 45 of the kind described. The divider output, which is essentially independent of fog level, is fed to any suitable alarm circuit 47. The fog detector 43 may be an infrared-light-emitting diode and a pair of photodiodes measuring the fog density between them.

Figure 3:
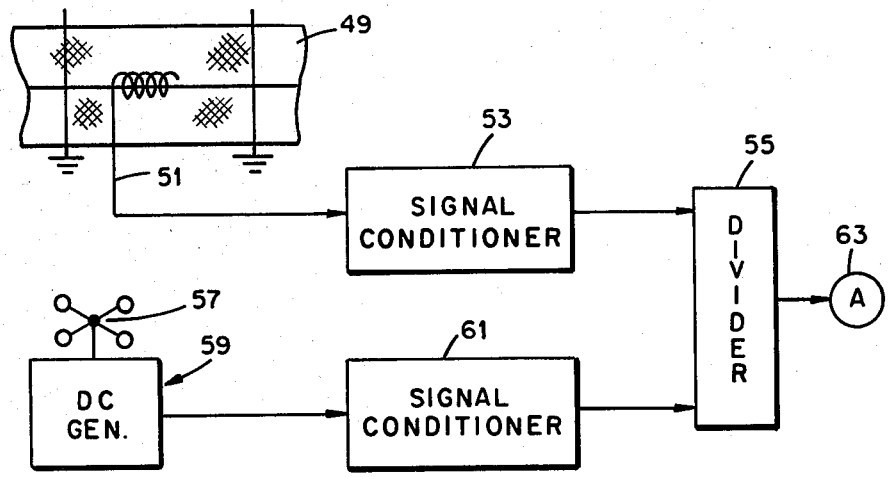
FIG. 3 is a schematic diagram of an intrusion-alarm utilizing a fence as the detection medium; in accordance with the invention, the system is designed to be insensitive to wind-induced movements of the fence.

FIG. 3 illustrates the invention as utilized to compensate for wind-induced false alarms in an intrusion-detection system of the kind wherein fence 49 defines an exclusion area. An acoustic cable 51 is fastened to the fence (detection medium) to convert movements thereof to a proportional electrical output. This output is fed through a signal-conditioning circuit 53. In accordance with the invention, the resulting detection signal is utilized as the numerator input to an analog divider 55. An arrangement comprising an anemometer 57 driving a D.C. generator 59 is utilized to generate an electrical output proportional to the velocity of the wind to which the fence is exposed. This output is passed through signal-conditioning means 61, and the resulting reference signal constitutes the denominator input to the divider. As shown, the output from the divider is fed to any suitable alarm means 63. Normally, the output from the divider is a signal indicative of intruder-generated noise and unaffected by changes in wind velocity.

The foregoing description of preferred embodiments of the invention is not intended to be exhaustive or to limit the invention to the precise forms disclosed. Obviously, many modifications and variations are possible in light of the above teachings. For instance, if desired, a conventional automatic gain amplifier may be substituted for the divider (13, FIG. 1). It is intended that the scope of the invention be defined by the appended claims.

What is claimed is:

1. In an intruder-detection system wherein an intruder-induced signal is transmitted through a medium whose signal-conductance changes with variations in a climatic condition to which said medium is exposed, the improvement comprising:

first means coupled to said medium for converting signals transmitted therethrough to a first electrical signal, second means for continuously generating an electrical reference signal proportional to the signal-conductance of said medium, third means for receiving the first electrical signal and said reference signal and generating therefrom an electrical output signal unaffected by said signal-conductance changes, and fourth means for giving warning when said output signal exceeds a selected value.

2. The system of claim 1 wherein said medium is earth and said reference signal varies responsive to climate-induced changes in the acoustic conductance thereof.

3. The system of claim 1 wherein said medium is air and said reference signal varies responsive to changes in the fog content thereof.

4. The system of claim 1 wherein said third means is an analog divider connected to receive the first electrical signal as its numerator input and said reference signal as its denominator input.

5. A system for giving warning of an intruder whose entry into an exclusion area induces vibrations in an acoustically conductive medium, comprising:

first transducer means couplied with a first portion of said medium for receiving a first acoustic signal therefrom and converting the same to a first electrical signal, means for introducing to a second portion of said medium a second acoustic reference signal of constant magnitude, second transducer means coupled with the second portion of said medium for receiving said second acoustic signal and converting the same to an electrical reference signal which is proportional to the acoustic conductance of said medium, means for conditioning the first electrical signal with said reference signal to convert the first electrical signal to an output signal which is insensitive to variations, in said acoustic conductance and means for receiving said output signal and giving warning when the same exceeds a selected value.

6. An intruder-detection system for giving warning of intruder-induced movements of a fence, comprising:

means for generating a first electrical signal proportional to movements of said fence, means responsive to wind incident on said fence, for generating an electrical reference signal proportional to the velocity of said wind, means for applying said reference signal to the first electrical signal to generate an output voltage insensitive to wind-induced movements of said fence, and means for giving warning when said output voltage exceeds a selected value.

7. An intruder-detection system for giving warning of intruder-induced variations in the intensity of a beam of radiation transmitted through air, comprising:

means for receiving said beam and converting the same to a first electrical signal, fog-responsive means for generating an electrical reference signal proportional to the fog content of said air, means for applying said reference signal to the first electrical signal to generate an output voltage insensitive to variations in said fog content, and means for giving warning when said output voltage exceeds a selected value.

8. In an intruder-detection system wherein an intrusion-generated signal transmitted through a detection medium is converted to a first electrical signal for energizing an alarm circuit, the first signal being subject to variations due to climate-induced changes in said medium, the method of operation comprising:

generating an electrical reference signal which varies responsive to said climate-induced changes in said medium, conditioning the first electrical signal with said reference signal to produce an electrical output signal which is unaffected by said changes in said medium, and impressing said output signal across said alarm circuit to actuate the same when said output signal exceeds a selected value.

9. The method of claim 8 wherein said conditioning is effected by providing an analog divider connected to receive the first electrical signal as its numerator input and said reference signal as its denominator input.

10. The method of claim 8 wherein said reference signal is generated continously.

* * * * *